US010961714B2

(12) United States Patent
Herrero-Smith et al.

(10) Patent No.: US 10,961,714 B2
(45) Date of Patent: Mar. 30, 2021

(54) COVER FOR WATER FLOW INLET

(71) Applicant: TAC-M COMPANY LIMITED, Bangkok (TH)

(72) Inventors: John Antonio Herrero-Smith, Bangkok (TH); Suchin Ratanasiriwilai, Bangkok (TH); Surachai Leelahakiat, Bangkok (TH)

(73) Assignee: TAC-M COMPANY LIMITED, Bangkok (TH)

( * ) Notice: Subject to any disclaimer, the term of this patent is extended or adjusted under 35 U.S.C. 154(b) by 0 days.

(21) Appl. No.: 15/575,741

(22) PCT Filed: May 25, 2015

(86) PCT No.: PCT/TH2015/000031
§ 371 (c)(1),
(2) Date: Nov. 20, 2017

(87) PCT Pub. No.: WO2016/190821
PCT Pub. Date: Dec. 1, 2016

(65) Prior Publication Data
US 2018/0112407 A1 Apr. 26, 2018

(51) Int. Cl.
*E04D 13/04* (2006.01)
*E04D 13/076* (2006.01)

(52) U.S. Cl.
CPC ..... *E04D 13/0409* (2013.01); *E04D 13/0404* (2013.01); *E04D 13/0767* (2013.01); *E04D 2013/0413* (2013.01)

(58) Field of Classification Search
None
See application file for complete search history.

(56) References Cited

U.S. PATENT DOCUMENTS 853,598 A * 5/1907 Rile ..... E04D 13/0409 210/166
1,761,257 A * 6/1930 Fleming ..... E04D 13/0409 210/166

(Continued)

FOREIGN PATENT DOCUMENTS

CN 2871699 Y 2/2007
CN 201128979 Y 10/2008

(Continued)

OTHER PUBLICATIONS

International Search Report (ISR) and Written Opinion (WO) dated Feb. 18, 2016 for International Application No. PCT/TH2015/000031.

(Continued)

*Primary Examiner* — Robert J Popovics
(74) *Attorney, Agent, or Firm* — Ladas & Parry LLP

(57) ABSTRACT

A cover for water flow inlet for rainwater drainage of roof and buildings is disclosed. The inlet cover comprises an outer formation forming a plurality of ridged fins to avoid the vortex formation of rainwater entrainment and to protect the cover from debris materials and a central plate member. The central plate member has a profiled lower surface. The plate member is of an inverted shape with a plurality of ridged formation or channels on the lower surface to further eliminate formation of air inducing and vortices, therefore promoting high volume laminar flow of water in the inlet pipe of the drainage system.

12 Claims, 3 Drawing Sheets

(56) References Cited

U.S. PATENT DOCUMENTS 2,121,220 A * 6/1938 Filkins ..... E04D 13/0409 210/166
2,142,343 A * 1/1939 Boosey ..... E04D 13/0409 210/166
2,666,493 A * 1/1954 Gordon ..... E04D 13/0409 210/166
3,212,416 A * 10/1965 Boersma ..... E03F 5/06 210/163
3,321,080 A * 5/1967 Pansini ..... E04H 4/1236 210/163
3,378,858 A * 4/1968 Jacuzzi ..... E04H 4/1236 210/163
3,529,723 A * 9/1970 Hagedorn ..... E04D 13/0409 210/163
D256,948 S * 9/1980 Boersma ..... D23/261
4,505,814 A * 3/1985 Marshall ..... E04D 13/0409 210/166
4,525,273 A * 6/1985 Logsdon ..... E04D 13/0409 210/164
4,652,365 A * 3/1987 Ebeling ..... E04D 13/0409 210/163
4,799,713 A * 1/1989 Uglow ..... E04D 13/0409 210/163
5,234,582 A * 8/1993 Savoie ..... E04D 13/0409 210/163
5,526,613 A * 6/1996 Simeone, Jr. ..... E04D 13/0409 210/163
5,615,526 A * 4/1997 Palmer ..... E04D 13/0409 210/163
5,618,416 A * 4/1997 Haefner ..... E04D 13/0409 210/163
5,724,684 A * 3/1998 Paar ..... E03C 1/26 4/286
5,735,091 A * 4/1998 Hawkins ..... E04D 13/0409 52/198
D439,957 S * 4/2001 Barnett ..... D23/261
6,340,035 B2 * 1/2002 Wright ..... E04H 4/1236 138/96 R
6,408,452 B1 * 6/2002 Bromley ..... E04H 4/1236 137/362
D460,810 S * 7/2002 Sommerhein ..... D23/261
6,416,674 B1 * 7/2002 Singleton ..... E03F 5/105 210/163
6,428,693 B2 * 8/2002 Singleton ..... B01D 29/15 210/163
6,453,482 B1 * 9/2002 Mullings ..... E04H 4/1236 4/286
D466,198 S * 11/2002 Mullings ..... D23/261
6,588,029 B2 * 7/2003 Mullings ..... E04H 4/1236 4/286
6,631,588 B1 * 10/2003 Distler ..... E04D 13/0409 210/163
D550,819 S * 9/2007 Seehoff ..... D23/261
D563,529 S * 3/2008 Labonte ..... D23/261
7,618,532 B2 * 11/2009 Worth ..... E03C 1/126 210/164
7,784,242 B2 * 8/2010 Warnecke ..... E04D 13/0409 210/163
7,887,697 B2 * 2/2011 Worth ..... E03C 1/126 210/164
7,891,907 B2 2/2011 Smith
8,496,822 B2 * 7/2013 Schoell ..... E04D 13/0409 210/232
8,557,108 B2 * 10/2013 Rennels ..... E03C 1/264 210/163
8,557,109 B1 * 10/2013 Sutherland ..... E03F 5/0409 210/163
8,834,714 B2 * 9/2014 Chien ..... E03F 1/00 210/163
9,175,797 B1 * 11/2015 Behoteguy ..... E03F 5/0411
9,435,435 B2 * 9/2016 Gavin ..... A62B 35/00
9,518,389 B1 * 12/2016 McDanal ..... E04D 13/0409
D781,401 S * 3/2017 Yan ..... D23/261
10,024,039 B2 * 7/2018 Cheng ..... E03C 1/264
10,113,303 B2 * 10/2018 Mardian ..... E03F 5/06
10,486,990 B2 * 11/2019 Epstein ..... C02F 1/68
10,487,492 B2 * 11/2019 Boersma ..... E03F 5/0408
10,519,666 B2 * 12/2019 Huber ..... E04D 13/0409
10,711,463 B2 * 7/2020 Huber ..... E03F 5/06
2001/0023842 A1 * 9/2001 Singleton ..... B01D 29/15 210/163
2003/0141231 A1 7/2003 Rattenbury et al.
2010/0213140 A1 * 8/2010 Won ..... E03C 1/264 210/767
2012/0222996 A1 * 9/2012 Rennels ..... E03C 1/264 210/163
2014/0158593 A1 * 6/2014 Chien ..... E03F 5/0404 210/166
2018/0112407 A1 * 4/2018 Herrero-Smith .... E04D 13/0404
2018/0119404 A1 * 5/2018 Boersma ..... E03F 5/06

FOREIGN PATENT DOCUMENTS

CN 202990269 U 6/2013
CN 203201044 U 9/2013
CN 104533031 A 4/2015
CN 104612337 A 5/2015
EP 1 160 390 A2 12/2001
GB 2 269 402 A 2/1994

OTHER PUBLICATIONS

Espacenet English abstract of CN 2871699 Y.
Espacenet English abstract of EP 1 160 390 A2.
Espacenet English abstract of CN 104533031 A.
Espacenet English abstract of CN 201128979 Y.
Espacenet English abstract of CN 203201044 U.
Espacenet English abstract of CN 104612337 A.
Espacenet English abstract of CN 202990269 U.

* cited by examiner

COVER FOR WATER FLOW INLET

RELATED APPLICATION

This application is an application under 35 U.S.C. 371 of International Application No. PCT/TH2015/000031 filed on May 25, 2015, the entire contents of which are incorporated herein by reference.

FIELD OF THE INVENTION

The present invention relates to an improved rain water collection system.

BACKGROUND TO THE INVENTION

Water flow inlets are predominantly designed to channel rainwater from roofs and buildings to various water drainage systems to avoid accumulation of high volumes of water which can cause flooding and water damage to building and roofing materials.

Various types of inlet systems are well known in the art. FIG. 1 depicts one of the simplest forms of rain water drainage system known in the art. The gutter comprises a narrow open trough (101), which collects rainwater from the roof of a building. The gutter is configured to have a water inlet at a first end (102) at which there is attached a downpipe (103) down which water is diverted away from the building, typically into a drain (not shown).

In a conventional gutter system as shown in FIG. 1, the rate of water flow is dictated by the amount of rainwater that falls on the roof via rainfall, and by gravity pulling water down the drainpipe. In many gutter systems, the trough is inclined so that water flows by force of gravity, by locating a first end of the trough at a lower position to a second end, thus so that water flow is directed towards drain pipe (103).

Such rainwater systems have been adapted as to incorporate multiple drainage outlets which further enhance the volume of water that can be collected by a drainage system in a given time. However, there is an inherent limit in the number of drainage outlets that can be inserted into a given length of gutter channel. This also leads to the need for multiple downpipes which is a disadvantageous as it can lead to obstruction issues for other structural building works and access points.

Another major problem is that the flow rates can only be increased to a certain level due to the constraints of gravitational pull. This is especially a problem during heavy rainfall. If the flow rate in the rainwater system is not the same or greater than the flow rate of water entering the gutter system, then the gutter system will overflow.

The problems mentioned above have led to the development of known siphonic drainage systems. Siphonic drainage systems typically used in buildings having roofs with a large surface area, for example airports, warehouses, stadiums and the like.

Referring to FIG. 2 herein, there is shown one example of a known siphonic drainage system comprising a plurality of siphonic inlets and a connecting collection pipe. Siphonic systems work by having substantially closed pipe systems where by the level of water entering the system is manipulated by the size of the water system (110, 114, 112) and/or the use of baffle plates at water inlets (111) to restrict the air entering the drainage system. When a system becomes full of water and therefore void of air, the action of water dropping down the downpipe (112) will cause a negative pressure to form at a top end of the downpipe (113). This negative pressure can be utilised to 'suck' water along the water pipe (114) installed horizontally connecting the water outlets at a higher level.

By using siphonic drainage processes, the rate of water flow is significantly increased relative to simple gravity dependent systems, and the need for multiple downpipes is reduced, because each downpipe carries water at a higher flow rate.

The pipe work in siphonic systems, is positioned inside the building adjacent or under the roof. For large buildings, one face of the building can span over 300 metres long. Drainage system are required to run the whole length of such building faces.

U.S. Pat. No. 7,891,907 B2 discloses a simple drainage device having an inlet having at least three substantially straight sides with rounded corners linking the at least three substantially straight sides. The sides and corners taper to form a circular outlet. The rounded corners are upper edges of channels of the device, and the channels are depressions in the sides. The drainage device is simple and alleviate formation of vortices without need of an anti-vortex plate.

US 2003/0141231 A1 discloses a baffle insert for conversion of gravity drains into siphonic drains. The baffle insert is placed into a sump bowl of a gravity drain and is designed to change hydraulic condition in the drain to a siphonic condition. The baffle plate comprises a baffle plate and a plurality of fin extensions coupled to a bottom of the baffle plate. The baffle is designed to eliminate the ingress of air and attempt to realize a full-bore flow within the downpipe of the drainage system.

GB 2 269 402 A discloses a drain outlet comprises a bowl for collection of water. The blow has a grill and a set of vanes for preventing formation of vortices of the water in the bowl. A baffle provided at above the outlet of the bowl prevents the ingress of air in with the water flow.

The above drainage systems suffer from a number of disadvantages.

However, though vortex is virtually eliminated by the plurality of fin extensions, air bubbles still can be accumulated under the baffle plate. The air bubbles then will enter into the flow and cause a reduction of the flowrate.

SUMMARY OF THE INVENTION

Embodiments of the present invention aim to provide an improved inlet rainwater system which can have an inlets substantially without fins to avoid potential blockage from debris materials. The proposed system may be utilised to incorporate a siphonic process so as to achieve an overall increased flow rate relative to a simple gravity based rainwater system. Furthermore, the unit is to be manufactured from metal, material with anti-UV coating or the like to avoid UV degradation.

According to a first aspect there is provided a cover for a rainwater inlet comprising:

- a plate member; and
- a grill coupled around a perimeter of said plate member;
- said grill having a plurality of spaced apart members, with apertures between said spaced apart members;
- said grill being formed into a ridge around the perimeter of said plate member, such that in side elevation view, a peak of said ridge lies above an upper surface of said plate member;
- said plate member has a profiled lower surface for guiding flow to the rainwater inlet.

Preferable said profiled lower surface of said plate member is provided with a plurality of channels therein and each channel is radially spaced apart to each other and extends from the perimeter of the plate member to the center of the plate member.

Preferable said profiled lower surface of said plate member may be provided with a plurality of ridges thereon and each ridge is radially spaced apart to each other and extends from the perimeter of the plate member to the center of the plate member.

Preferably the cover may further comprises a plurality of mounting means protruding from the profiled lower surface of the plate member for mounting the cover over the rainwater inlet and defines a predetermined gap between the profiled lower surface and the outer rim of the rainwater inlet.

Preferably each of the plurality of channels of the profiled lower surface may has a triangular shape in cross section.

Preferably said grill comprises a plurality of inwardly facing apertures positioned between said plate member and said peak of said ridge.

Preferably said grill comprises a plurality of outwardly facing apertures positioned around a perimeter of said grill.

Preferably a plurality of said spaced apart members is arranged such that each one of the member extends in a first direction transverse to a main plane of said plate; and a second plurality of spaced apart members, extends in a second direction transverse to said main plane of said plate, said first and second transverse directions being transverse to each other and transverse to said main plane.

Preferably said plate member and said grill form a substantially cratered shape, wherein said grill forms a ridge around said plate member.

Preferably said central plate is substantially circular.

Preferably said central plate may be of substantially octagonal shape.

Preferably said plate member comprises a substantially inverted cone shaped underside.

Preferably said plate member comprises at least one hole therein for draining rainwater.

Preferably the cover may further comprise a plurality of outwardly extending substantially inverted "v" shaped arms, having a plurality of said apertures there between.

Preferably an outer perimeter of said plate member is positioned at a height above a height of an outer perimeter of said grill.

Preferably a diameter of said grill is larger than that of said plate member. Other aspects are as recited in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION

Figure 1:
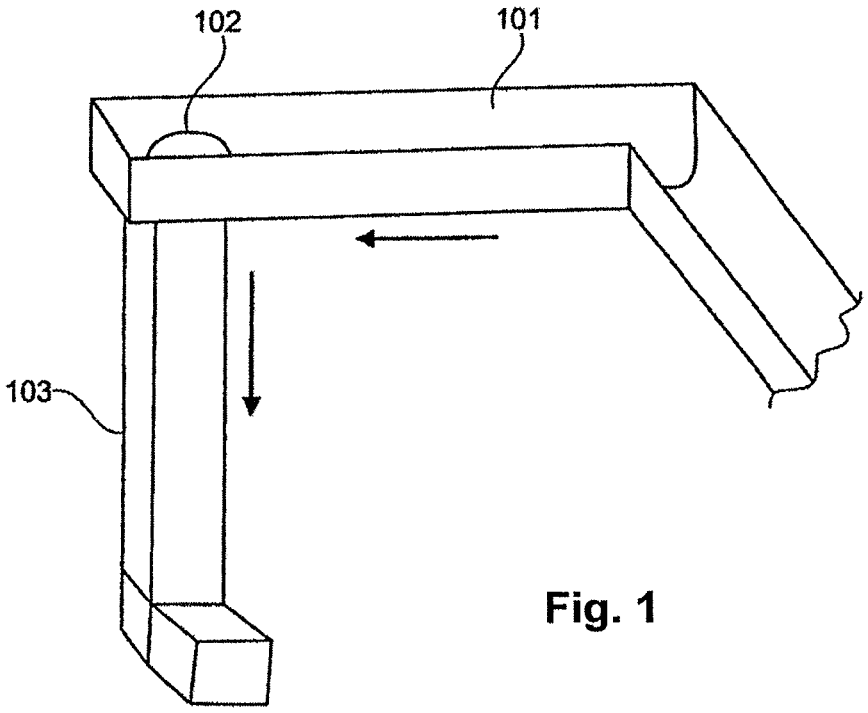
FIG. 1 is a diagram of a simple gravity based gutter system as known in the art.

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

The inlet comprises a substantially circular central plate 300, surrounded, at a perimeter thereof by a plurality of radially extending arms 301, substantially equidistantly spaced apart around the perimeter of the plate 300; a first substantially circular ridge portion 302 connecting the plurality of arms 301; and a second substantially circular connecting ring member 303 which connects the outer ends of the outwardly extending arms. The central plate 300 comprises one or a plurality of apertures 304 which enable the inlet cover to be fixed, for example by bolts, to either a tubular inlet pipe, a siphonic bowl, or a conventional gravity down pipe.

The plurality of inner arm portions 305 define a plurality of inner apertures 307 which face inwardly towards the center of the plate member 300, arranged around the plate member in a circle. Each inner aperture is defined by a perimeter of the plate, a pair of adjacent arms, and the upper ring member 302.

The plurality of outer arm portion 306 define a second set of apertures, which face outwardly from the center of the water inlet, each aperture defined an adjacent pair of outer arm portion 306, at an upper end by the inner circular connecting member 302, and at a lower end by the outer circular connecting member 303.

The water inlet cover comprises two main functional parts. Firstly, the central plate member acts to exclude air from entering the downpipe or bowl (depending on which type of rainwater system the inlet cover is fitted to) during high flow conditions. Excluding air from immediately above the center of the pipe or bowl promotes a greater water flow and can encourage the onset of siphonic behavior.

Secondly, the radially extending arms act as an outer grill which prevents debris over a particular size from entering the inlet, since the debris (primarily leaves, but also including items of litter roofing materials such as bolts, or roof panel fragments etc.) from entering the drainage system. The arms create a ridged grill consisting of grill members (the arms) with a plurality of apertures there between. The ridged shape of the arms tends to keep the debris on the outer perimeter of the inlet cover under lower and moderate levels of water flow, as the debris cannot pass over the top of the ridge into the center of the cover.

Figure 3:
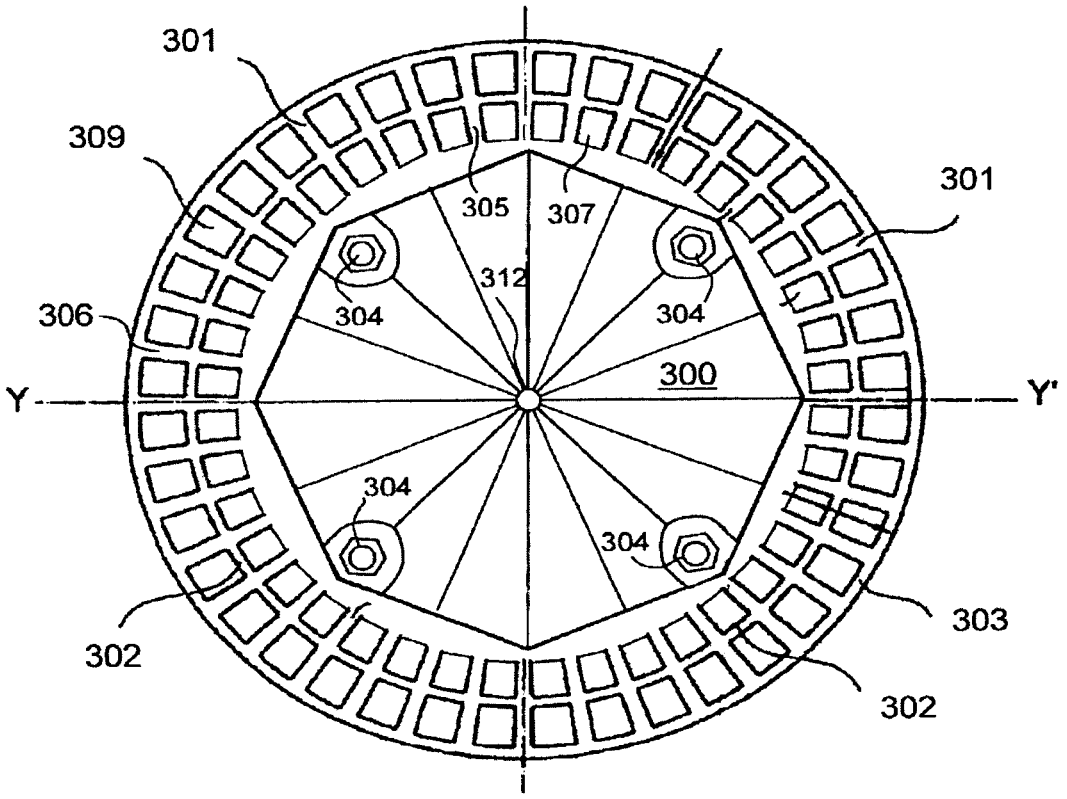
FIG. 3 shows schematically in plan view, a cover for rainwater inlet having a leaf guard/debris guard vortex reducing means according to the present invention.
Figure 4:
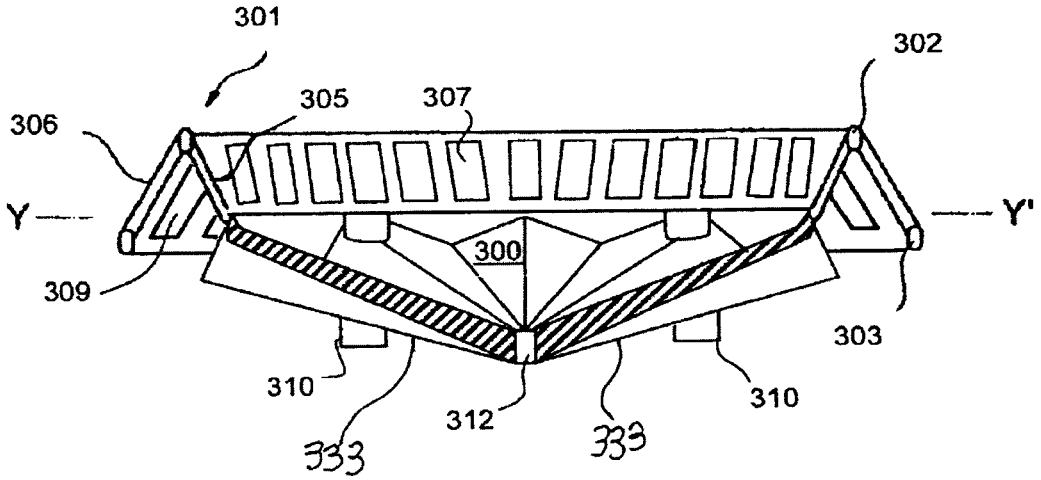
FIG. 4 shows the cover of FIG. 3 in cross section view from one side of the cover.

Referring to FIG. 4 herein, there is illustrated schematically in cut away view from one side, the inlet cover of FIG. 3, along the line Y-Y'. Each arm 301 comprises an inner inclined section 305 extending between a perimeter of the central plate member and the inner connecting ring 302, and a second inclined portion 306 extending between the inner connecting ring 302 and the outer connecting ring 303. The inner inclined arm portion 305 is arranged so as to be relatively shorter compared to the outer inclined portion 306, an upper end of the inner inclined arm portion meeting an upper end of the outer inclined arm portion 306 at the position of the inner ring member 302. As viewed in cut away profile, the arm portion is of a substantially inverted "V" shape having a relatively longer outer arm portion, so that the arm resembles a spider leg arrangement.

In a modified embodiment, the outer ring member 303 may be omitted, so that the lower ends of each outer arm portion 306 are unconnected to each other. The substantially circular plate member 300, viewed in cross section from one side comprises a substantially inverted cone shaped underside.

The profiled lower surface of the plate member 300 is designed to assist in changing the direction of water flow from horizontal as it enters the inlet from side of the cover to direct the water down the water inlet or downpipe to minimize the formation of vortices as the water is directed to the down pipe below. Thereby, a ridge formation comprising a plurality of ridges or channels 333 on the underside of the plate member 300 will improve efficiency of the rainwater drainage by depriving of air bubbles from the flow.

The profiled lower surface of the plate member 300 are arranged such that the cross section area of the channel decrease in a direction towards the water inlet of downpipes. Preferably each of the plurality of channels of the profiled lower surface has a triangular shape in cross section.

Referring to FIG. 4, showing the peaked inverted "V" shape of the arm, and the connecting ridge portion 302. Debris collects preferentially on the outside of the arm, at the longer length of the arm in preference to inside the ring 302 due to the overall crater like shape of the cover, and the ridged grill formed by the arms.

Water collected above the central plate member 300 can be drained from the plate member 300 through at least one hole 312 formed therein and flows into an underlying drain pipe or collecting bowl. The outer portions of the radially extending arms define there between a plurality of outwardly facing apertures, through which water can drain from a position outside of the inlet cover, for example water collecting on a flat surface of a gutter channel, and which can drain through the outer apertures in to the underlying rain water collection pipe, enclosed channel or siphonic bowl.

Each arm has an inner upright portion and an outer upright portion, connected at an upper ridge 302, so that the plate member 300 and grill form a substantially cratered shape, wherein said grill forms a ridge 302 around the central plate member 300.

The cover is provided with a plurality of mounting means 310 which protrude from the profiled lower surface of the plate member 300 for mounting the cover over the rainwater inlet by means of bolts, screws or fastening device. The mounting means 310 is also intended to define a predetermined gap between the profiled lower surface and the outer rim of the rainwater inlet in order to change hydraulic condition in the drain to a siphonic condition.

In use, under moderate water flows, water encountering the inlet will flow between the outer apertures 309 and down in to the rain water collection pipe or collection bowl underneath. Any debris such as leaves, twigs or litter will be prevented from flowing in to the drain by the outwardly extending arms 306. However, the leaves, litter and debris may still lie across the apertures 306, which means that further debris and standing water may build up behind the leaves and debris. Water flowing over the leaves and debris may flow over the top of the ridge 302 and the ring connecting member, and in to the center of the "crater" surrounded by the ridge 302. Water entering the center of the inlet will flow outwardly towards the inner apertures 307 and the hole 312, and down in to the rain water pipe or collection bowl. Clearly, if there is enough debris, litter or leaves such that the inlet is completely blocked with debris, then having both an outwardly facing and an inwardly facing sets of apertures will not prevent blockages and the inlet cover becoming blocked altogether. However under less extreme volumes of debris, debris will be preferentially retained outside the center of the crater, leaving the inner apertures unobstructed and capable of draining water.

Where the inlet cover is fitted directly to a gutter floor, an aperture in the gutter floor, an upper surface of the plate is positioned at a height above a height of an outer perimeter of said cover, such that when the cover is fitted to a gutter floor, the plate lies substantially parallel to, and above a level of said gutter floor.

It will be appreciated by the skilled person that the embodiments of FIGS. 3 to 4 may be formed in a variety of ways, such as by plastics mouldings, or as a metal casting. In other embodiments, the surrounding grill barrier may be formed from wire mesh shaped into a ridged ring.

A further advantage of the specific embodiments disclosed herein is that using a same trough width and cover width, the widths and the cross sectional areas of the internal channels can be varied over a range to optimize the onset of siphonic behavior gutter to different roof areas and designed for rainfall rates using a single set of trough and cover dimensions, by inserting different widths of tapered insert member. The system can be designed to meet various different levels of rain fall and roof area, using the same trough and cover members, with the design changes occurring only on the foam inserts, the diameters and/or cross sectional areas of the inlets and outlets. This has the advantage of standardizing components for the trough and covers and thereby reducing overall system costs by avoiding the need to manufacture different trough and cover sizes. Optimization of the water flow rates, sizes of inlet and outlet apertures, and the shape and cross sectional area of the internal channels at each position along the channel can be determined by computer implemented calculations, to give an optimum designed system for each building, roof area and climate. Both the height and the width of the gap are design parameters which can be easily varied, by use of different height vertical spacers and different width or shaped insert members, using a single trough shape.

Specific embodiments disclosed herein may have an advantage of permitting, siphonic behavior of one or more inclined or substantially horizontal water channels, where each channel drains to a same end of a gutter system. Further, two such gutter systems can be placed end to end, with their outlet ends placed opposite to each other, and their respective inlet ends placed adjacent to each other so as to enable drainage of a length of roof of the order of 400 metres or more using siphonic guttering, without the need for any down pipes to be present in the middle of the span between the two outlet ends of the end to end gutter lengths. This may avoid the need to fit drains in the center of a building's concrete floor slab, or at least reduce the amount of such drains needed.

Figure 2:
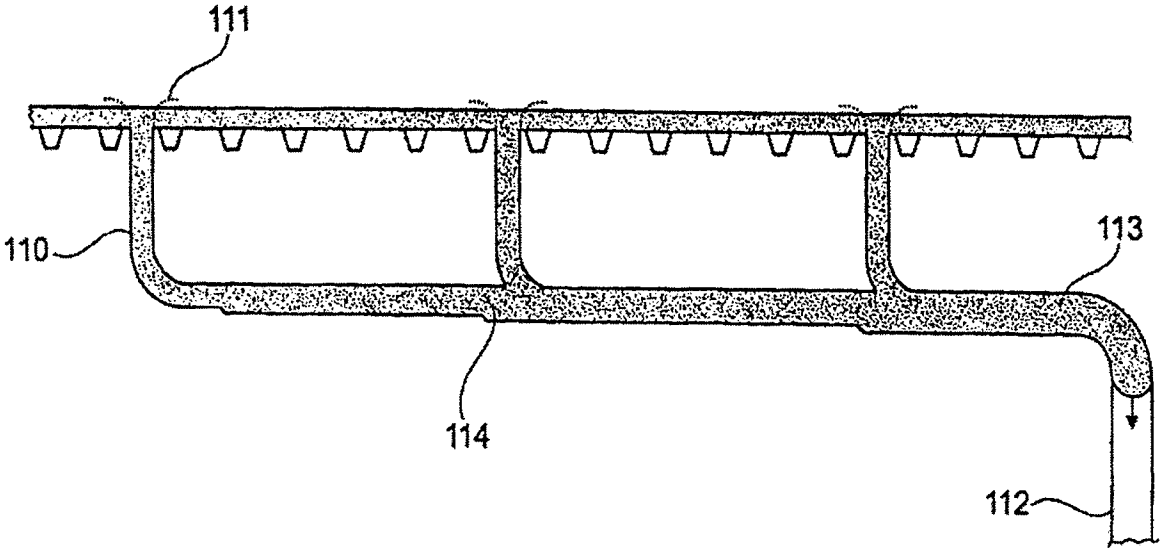
FIG. 2 shows schematically a siphonic gutter system which is known in the art.

Further, since the internal shape of the channels promotes siphonic behavior in the channels themselves, there is no need for an additional horizontal or shallow inclined parallel pipe inside the building, as in the prior art case shown in FIG. 2 herein. This avoids additional piping internal to the building, and avoids the additional jointing with its associated inspection and maintenance and risk of leakage inside the building.

Further, conventional siphonic systems comprising lengths of pipe and siphonic inlets as shown in FIG. 2 herein, have step changes in pipe size at every inlet, and are restricted by the available pipe diameters to a limited range of cross sectional areas of water channel in the pipe. In contrast, in the specific embodiments herein, the channel cross sectional area is continuously variable as a design parameter, allowing greater optimization of cross sectional area at any distance along the water channel and enabling greater optimization of the water flow. Whereas conventional pipe based siphonic systems are designed to be optimized around a single rainfall rate, and the pipe sizes are fixed once installed, this means that the conventional systems may not perform optimally at other ranges of rainfall, for example 60% of "design for" rainfall rate. In contrast, the embodiments presented herein have a continuously tapered channel cross section and can therefore be designed for optimized performance over a range of rainfall rates, rather than just one target rainfall rate, because they are not restricted by predetermined pipe sizes. The embodiments described herein may be designed to operate siphonically over a greater range of rainfall rates than a known pipe based siphonic drainage system, and can be designed to become siphonic at a large range of fill levels of the primary channels, compared to known pipe based siphonic systems. In turn, this means that the risk of overflow of the open channel which collects the rainwater prior to entering the inlets is reduced compared to known systems, because the open upper channel is drained more quickly. This has the advantage of reducing the risk of flood or water damage inside the building due to gutter overflow compared to known systems, the occurrence of which is often incorrectly attributed to leaking joints, resulting in unnecessary system maintenance in prior art pipe systems.

The invention claimed is:

1. A cover for a rainwater inlet comprising:

a plate member; and a grill coupled around a perimeter of said plate member;

said grill having a plurality of spaced apart members, with apertures between said spaced apart members;

said grill being formed into a perimeter ridge around the perimeter of said plate member, such that in a side elevation view, a peak of said perimeter ridge lies above an upper surface of said plate member;

said plate member comprising a body, having a cross section of a substantially inverted cone shaped underside, wherein the body has a lower surface that is sloped and profiled with a formation of lower surface ridges, the body being mountable over the rainwater inlet in an installed disposition wherein the lower surface contacts water flowing toward the rainwater inlet in a horizontal direction and re-directs the flowing water down the rainwater inlet with the lower surface ridges configured to inhibit air bubbles from forming in the flowing water whereby to improve efficiency of the water drainage;

wherein the profiled lower surface has a cross section area that decreases in a direction towards the rainwater inlet, and wherein the upper surface of the plate member slopes from an upper portion under the perimeter ridge to a lower portion over the inlet, the upper surface having a hole in the lower portion such that, with the body mounted over the rainwater inlet in the installed disposition, water passing onto the upper portion is guided to the hole for draining into the rainwater inlet.

2. The cover according to claim 1, wherein each of profiled portions of said profiled lower surface of said plate member is radially spaced apart to each other and extends from the perimeter of the plate member to the center of the plate member.

3. The cover according to claim 1, wherein each of the lower surface ridges in the formation of lower surface ridges is radially spaced apart from each other and extends from the perimeter of the plate member to the center of the plate member.

4. The cover according to claim 1, further comprising a plurality of mounting means protruding from the profiled lower surface of the plate member for mounting the cover over the rainwater inlet and defining a predetermined gap between the profiled lower surface and the outer rim of the rainwater inlet.

5. The cover according to claim 1, wherein each of profiled portions of the profiled lower surface has a triangular shape in cross section.

6. The cover according to claim 1, wherein said grill comprises a plurality of outwardly facing apertures positioned around a perimeter of said grill.

7. The cover according to claim 1, wherein a plurality of said spaced apart members, each extend in a first direction transverse to a main plane of said plate; and a second plurality of spaced apart members, extend in a second direction transverse to said main plane of said plate, said first and second transverse directions being transverse to each other and transverse to said main plane.

8. The cover according to claim 1, wherein said central plate is substantially circular.

9. The cover according to claim 1, wherein said central plate is substantially octagon.

10. The cover according to claim 1, further comprising a plurality of outwardly extending substantially inverted "v" shaped arms, having a plurality of said apertures there between.

11. The cover according to claim 1, wherein an outer perimeter of said plate member is positioned at a height above a height of an outer perimeter of said grill.

12. The cover according to claim 1, wherein a diameter of said grill is larger than that of said plate member.

* * * * *